US009243785B2

(12) United States Patent
Corkill

(10) Patent No.: US 9,243,785 B2
(45) Date of Patent: Jan. 26, 2016

(54) WALL MOUNT LIGHT ASSEMBLY

(71) Applicant: Kirby Corkill, Chicago, IL (US)

(72) Inventor: Kirby Corkill, Chicago, IL (US)

( * ) Notice: Subject to any disclaimer, the term of this patent is extended or adjusted under 35 U.S.C. 154(b) by 38 days.

(21) Appl. No.: 14/263,975

(22) Filed: Apr. 28, 2014

(65) Prior Publication Data

US 2015/0308667 A1 Oct. 29, 2015

(51) Int. Cl.

| | |
|---|---|
| ***F21V 21/02*** | (2006.01) |
| ***F21S 8/00*** | (2006.01) |
| ***F21V 5/04*** | (2006.01) |

(52) U.S. Cl.

CPC ..... *F21V 21/02* (2013.01); *F21S 8/033* (2013.01); *F21V 5/04* (2013.01)

(58) Field of Classification Search

USPC ..... 362/362, 367, 368, 372, 147

See application file for complete search history.

(56) References Cited

U.S. PATENT DOCUMENTS

| | | | | |
|---|---|---|---|---|
| 7,296,914 | B1 * | 11/2007 | Russello et al. | 362/285 |
| 2008/0094838 | A1 * | 4/2008 | Russello et al. | 362/250 |

* cited by examiner

*Primary Examiner* — Laura Tso

(74) *Attorney, Agent, or Firm* — The Watson I.P. Group, PLC; Jovan N. Jovanovic; Vladan M. Vasiljevic

(57) ABSTRACT

A wall mount light assembly having a mounting base and a light housing. The mounting base has a base wall, and a plurality of walls extending outwardly therefrom that terminate at a distal end. The foregoing cooperatively defining a front opening perimeter. The base wall and the front opening perimeter are oblique to each other. The light housing comprises a lens portion and a mating perimeter. The lens portion and the mating perimeter are oblique to each other. The mating perimeter of the light housing and the front opening perimeter are configured to matingly engage in at least two different orientations. In each of the orientations, the position of the base wall relative to the lens portion is different, so as to direct a light emanating through the lens portion in a different direction.

14 Claims, 6 Drawing Sheets

WALL MOUNT LIGHT ASSEMBLY

CROSS-REFERENCE TO RELATED APPLICATION

N/A

BACKGROUND OF THE DISCLOSURE

1. Field of the Disclosure

The invention relates in general to lighting, and more particularly, to a wall mount light assembly which can be configured to provide light in particular directions through reconfiguration.

2. Background Art

The use of lighting is ubiquitous. Among other lighting options, it is often the case that a wall mount or side mount light is utilized where illumination is desired either below or outwardly and downwardly from the wall. To achieve the same, it is often necessary to produce multiple different lights. For example, one housing and lens combination directs light in a downward direction, generally perpendicular to the wall. A second light (housing and lens combination) directs the light in a downward and outward direction. Due to the different desired orientations, it is necessary to produce a number of different components.

It would be advantageous to have a single light assembly that includes different mounting options so as to direct the light in at least two different orientations.

It would be advantageous to also produce a single light assembly that can be mounted in at least two orientations, wherein in each orientation, the direction of the light is different.

It would also be advantageous to produce a single light assembly that can be changed without fully dismounting the light from the wall or other generally vertical surface.

SUMMARY OF THE DISCLOSURE

The disclosure is directed to a wall mount light assembly comprising a mounting base and a light housing. The mounting base has a base wall, and a plurality of walls extending outwardly therefrom that terminate at a distal end. The foregoing cooperatively defining a front opening perimeter. The base wall and the front opening perimeter are oblique to each other. The light housing comprises a lens portion and a mating perimeter. The lens portion and the mating perimeter are oblique to each other. The mating perimeter of the light housing and the front opening perimeter are configured to matingly engage in at least two different orientations. In each of the orientations, the position of the base wall relative to the lens portion is different, so as to direct a light emanating through the lens portion in a different direction.

In a preferred embodiment, the at least two different orientations comprise a first orientation and a second orientation. In the second orientation, the mounting base is rotated a half turn relative to the first orientation.

In some such embodiments, in the first orientation, the light emanating through the lens portion is directed in a generally downward direction. In such an orientation, the lens portion is substantially perpendicular to the base wall. In the second orientation, the light emanating through the lens portion is directed in a direction that is outward and downward, and, the lens portion is substantially oblique to the base wall.

In another preferred embodiment, the base wall has a substantially rectangular member. Additionally, the front opening perimeter comprises a substantially rectangular member.

In another preferred embodiment, the plurality of walls of the mounting base has a pair of ends which are parallel to each other and spaced apart from each other. A pair of sides extend between the pair of ends.

In another preferred embodiment, the plurality of walls define a substantially rectangular member.

In another preferred embodiment, the pair of sides has a first side that has a first width and the second side has a second width. The first width is larger than the second width.

In another preferred embodiment, the light emanating from the lens portion comprises one of a discharge, LED and incandescent light.

In another preferred embodiment, the light housing is coupled to the mounting base through at least one removable fastener.

In yet another preferred embodiment, the front opening perimeter is angled relative to the base wall at an angle of between 10° and 60°. The lens portion and the mating perimeter are angled relative to each other at an angle of between 75° and 85°. Of course other angles are contemplated.

In another aspect of the disclosure, the disclosure is directed to a method of redirecting a wall mount light assembly. The method comprises the steps of: providing a mounting base with a base wall and a front opening perimeter spaced apart from the mounting base and oblique thereto, the base wall and front opening perimeter defining a cavity; providing a light housing including a lens portion and a mating perimeter spaced apart from the lens portion, and disposed obliquely thereto; positioning the mating perimeter in mating engagement with the front opening perimeter in a first orientation, wherein the lens portion is directed at a first angle relative to the base wall; and repositioning the mating perimeter in mating engagement with the front opening perimeter in a second orientation, wherein the lens portion is directed at a second angle relative to the base wall, wherein the first angle and the second angle are different.

In a preferred embodiment, the step of repositioning further comprises the steps of rotating the light housing relative to the mounting base through a half turn; and positioning the mating perimeter in mating engagement with the front opening perimeter in the second orientation.

In another preferred embodiment, the step of positioning further comprises the step of releasably attaching the light housing to the mounting base through at least one fastener, and the step of repositioning further comprising the step of releasing the light housing from the mounting base.

In yet another preferred embodiment, the step of repositioning further includes the step of reattaching the light housing to the mounting base in releasable engagement.

BRIEF DESCRIPTION OF THE DRAWINGS

The disclosure will now be described with reference to the drawings wherein.

DETAILED DESCRIPTION OF THE DISCLOSURE

Figure 1:
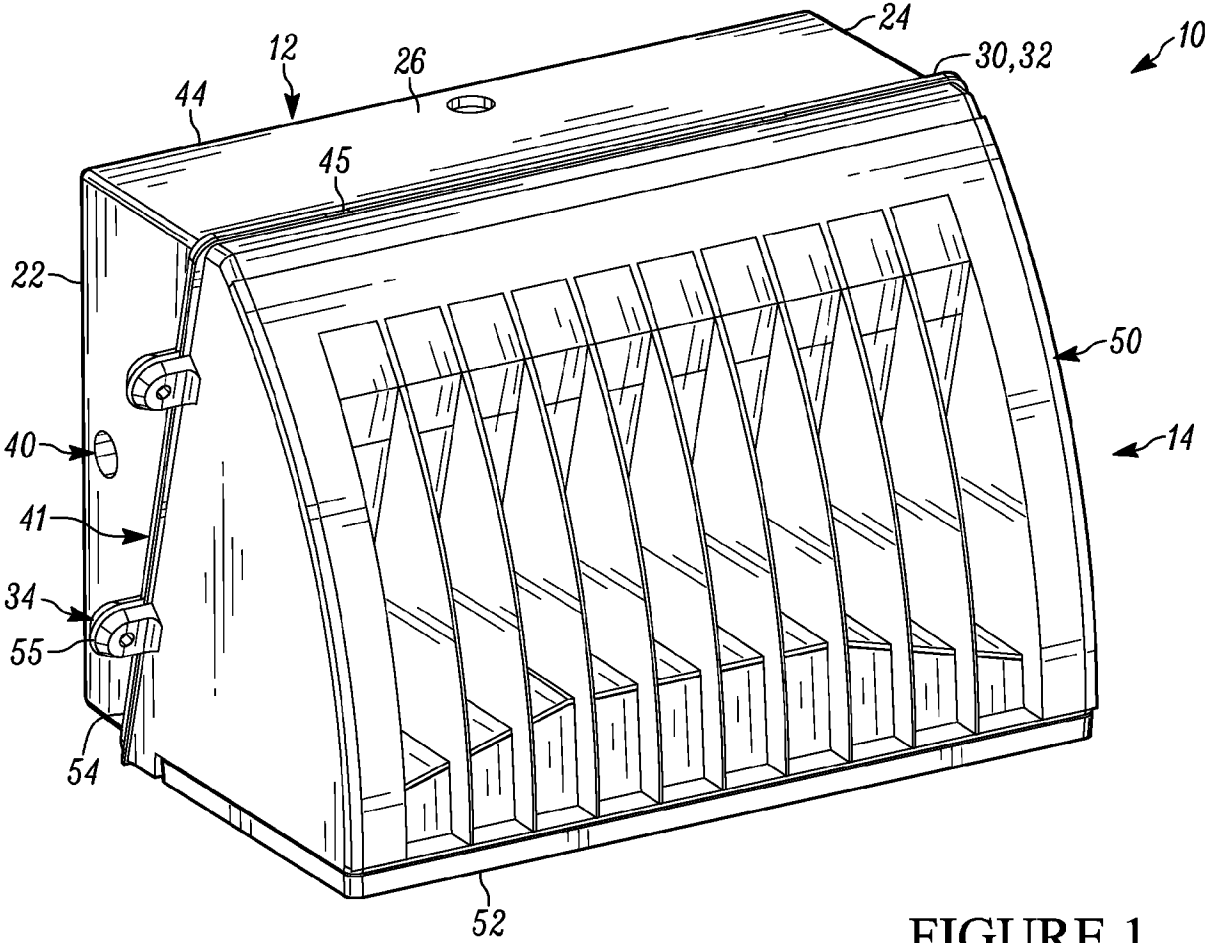
FIG. 1 of the drawings is a perspective view of the wall mount light assembly of the present disclosure, showing, in particular, the mounting base coupled to the light housing in a first orientation.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the wall mount light assembly is shown generally at 10. Often, the wall mount light assembly is configured for use on the side of a building or wall, while such a configuration is not required. It is often the case that with such wall mount lights, it may be desirable to have the light directed downwardly, while in other instances, it may be desirable to have the light directed outwardly and not directly downwardly. In either case, the same light assembly can be utilized, and as will be explained, it is only necessary to couple the components in a different manner to achieve the same.

Figure 2:
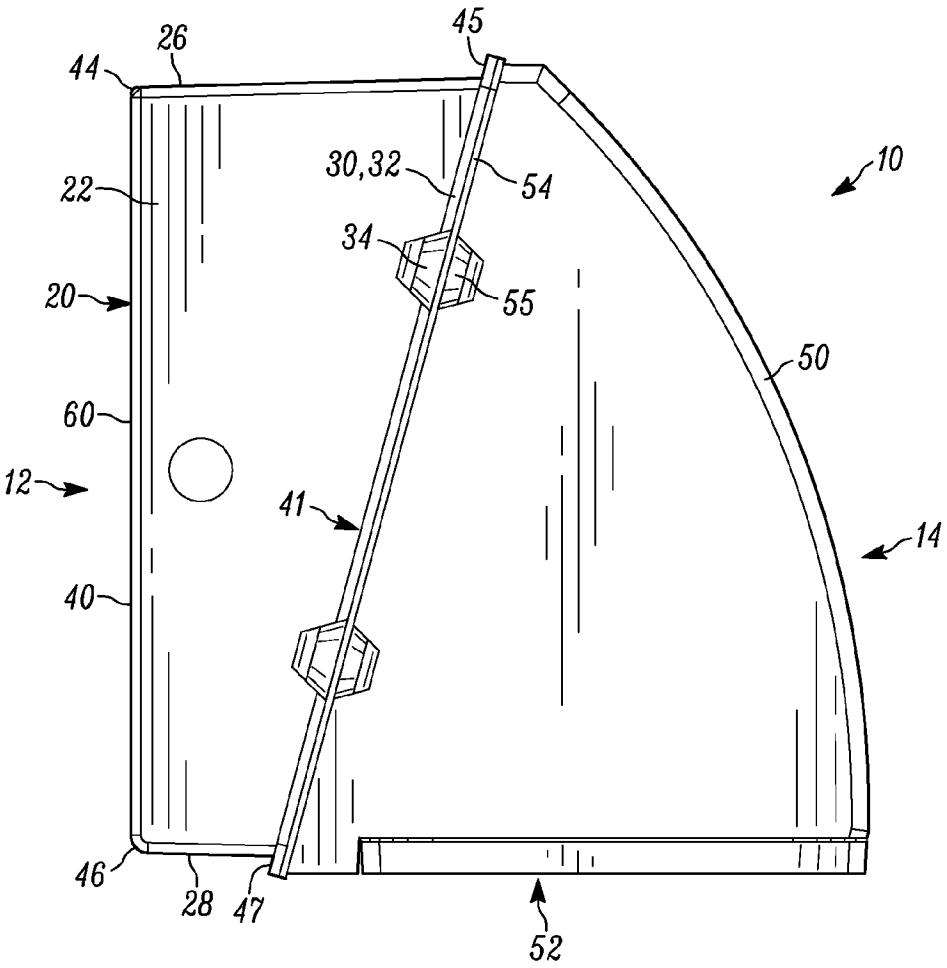
FIG. 2 of the drawings is a side elevational view of the wall mount light assembly of the present disclosure, showing, in particular, the mounting base coupled to the light housing in the first orientation.

Referring again to FIGS. 1, 2, 4 and 6 collectively, the wall mount light assembly 10 is shown as comprising mounting base 12 and light housing 14. The mounting base is shown in FIG. 2 in more detail as comprising base wall 20, first end wall 22, second end wall 24, first joining wall 26 and second joining wall 28. The base wall 20 is generally substantially planar and is configured for abutment and attachment to a wall, and includes outer surface 60 and inner surface 62. Thus, the base wall 20 may include surface features and openings for fasteners and the like so as to be able to join the mounting base 12 to an outside surface, such as a wall. Additionally, openings and the like may be positioned on the base wall to accommodate various electrical conduit and electrical wiring. While not required, typically the base wall 20 comprises a rectangular configuration, although other configurations, such as other geometric shapes, like, circles, squares, polygons and the like are contemplated, as are arbitrary shapes. In the embodiment shown, the rectangular configuration has shorter ends 35, 36 and longer sides 37, 38.

The first end wall 22 and the second end wall 24 extend outwardly from the ends 35, 36 respectively of the base wall 20. The first wall includes proximal end 40 and distal end 41 defining a width as the distance therebetween. The first end wall 22 is configured so that the width decreases from the side proximate the first side 37 to the side proximate second side 38. It is contemplated that The particular angle of the inclination may be varied so that the width is varied between sides 37, 38. It is desirable that the proximal end and the distal end do not meet at the side 37, so that there is some width of the first end wall at side 37, although it is not required.

Preferably, the second end wall 24 is substantially identical in configuration and includes proximal end 42 and distal end 43, and the second end wall is spaced apart from the first end wall, on opposite sides of the base wall 20. It will be understood that either or both of the end walls 22, 24 may include openings or frangible components which may be removed to create openings for receiving a conduit or outside electrical lines, or to couple to sensors (such as motion sensors) and the like.

The first joining wall 26 extends between the first end wall 22 and the second end wall 24 at the side 37. The second joining wall 28 extends between the first end wall 22 and the second end wall 24 at the side 38. Each of the first joining wall and the second joining wall have proximal ends 44, 46, respectively, and distal ends 45, 47. It will be understood that the joining walls generally comprise rectangular configurations.

The end walls 22, 24 and the joining walls 26, 28 together define front opening perimeter 30, which, as will be explained, provides the attachment point for the light housing. Flange 32 may be defined around a portion or all of the front opening perimeter 30 so as to provide a sealing and attachment surface for a gasket or the like. In the embodiment shown, the flange 32 is substantially planar, but other configurations are likewise contemplated. A plurality of mounting structures may be provided, including openings in the flanges (or enlarged flange portions) for fasteners, or locations for clips, connections, or other types of fasteners, as well as covered hinges, and the like. It is contemplated that removable fasteners may be utilized, or that security fasteners may be utilized to minimize theft and vandalism. In the embodiment shown, the flange 32 generally comprises a rectangular configuration.

The foregoing walls, together with the base wall 20 define cavity 29 which may be large enough to accommodate some of the wiring for the light assembly, or additional hardware. In other embodiments, the cavity is rather small, and the mounting base merely provides the base upon which the light housing is mounted, and the particular structure for properly directed light emanating from the light housing 14.

It will be understood that in other embodiments the front opening perimeter may have a different shape, due to a different shape of the base wall. In the embodiment shown, the end walls and the joining walls are perpendicular to each other and to the base wall defining at front opening perimeter that has the same general shape as the base wall. In other embodiments, the end walls and the joining wall may be oblique to the base wall, thereby resulting in a front opening perimeter that is of different shape than the base wall. In still other embodiments, it will be realized that the front opening perimeter may have a continuous configuration (such as a circle, oval, ellipse, or the like) such that the separation thereof into segments is difficult.

Light housing 14 is shown in FIGS. 2 through 5 as comprising opaque portion 50, lens portion 52 and mating perimeter 54. The opaque portion 50 provides a housing for the different electrical components and the different light components and provides space therefor. The configuration of the housing may be any number of different configurations. The lens portion 52 corresponds to the portion of the light housing 14 through which light is cast. For example, the lens portion 52 may comprise a transparent or translucent portion to which can be substantially planar, such as the embodiment shown in FIG. 1, or may extend to multiple surfaces of the light housing 14. It will be understood that any number of different light elements are contemplated, discharge, LED, incandescent, among others are contemplated, and the disclosure is not limited to any particular light element. It will be understood that a power supply or surge protector may be incorporated into the mounting base 12, and the optical components (including, but not limited to an LED light source and lens optics, or a LED light source plus reflector, or an incandescent, CFL or other type of lamp and reflector) may be positioned in the light housing 14.

The mating perimeter 54 is disposed at the opaque portion 50 and oblique to at least a portion of the lens portion 52. It will be understood that the mating perimeter 54 is configured to matingly engage front opening perimeter 30 in mating (and preferably sealed) engagement. It will be understood that the mating perimeter 54 may include mounting structures 55 which correspond to structures 34 found on the front opening perimeter 30 of the mounting base.

Advantageously, the light housing includes a mating perimeter 54 which can be coupled to the front opening perimeter 30 in at least two different orientations. Due to the oblique position of the lens portion 52 relative to the mating perimeter 54, in the two different configurations, the light will be directed through the lens portion 52 in two different directions, depending on the manner of mounting.

Figure 3:
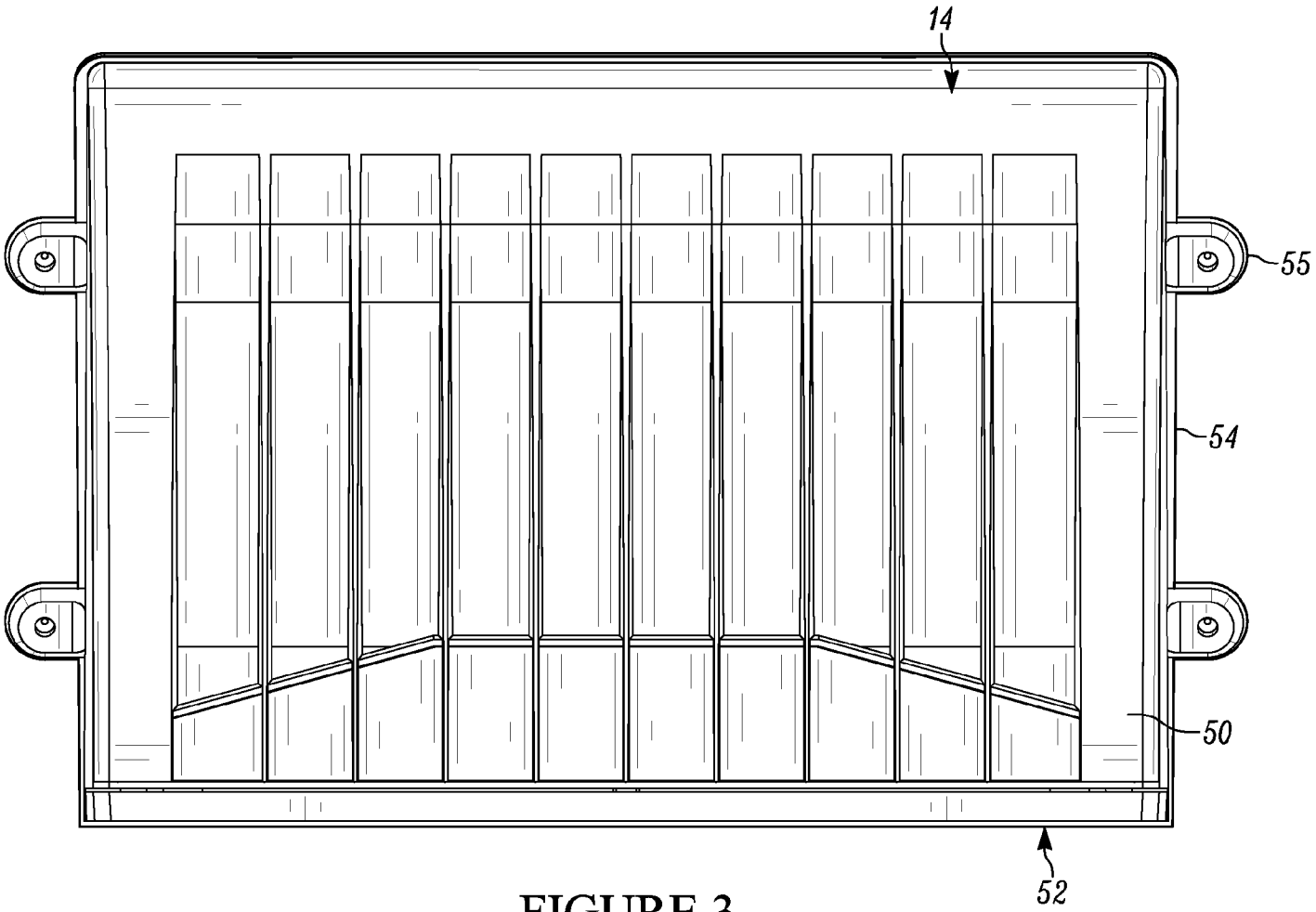
FIG. 3 of the drawings is a front elevational view of the wall mount light assembly of the present disclosure, showing, in particular, the mounting base coupled to the light housing in the first orientation.

More specifically, if mounted in the manner shown in FIGS. 1, 2 and 3, the light will be directed through the lens portion 52 in a downward direction. More specifically, the orientation of the mating perimeter 54 of the light housing and the lens portion 52 of the light housing, relative to each other, as well as the configuration of the front opening perimeter 30 relative to the base wall 20 of the mounting base, the resulting position of the lens portion 52 is generally horizontal and in a downward direction (generally perpendicular to the wall to which the light assembly is mounted). As a result, the light emanating therethrough will be directed downwardly.

Figure 4:
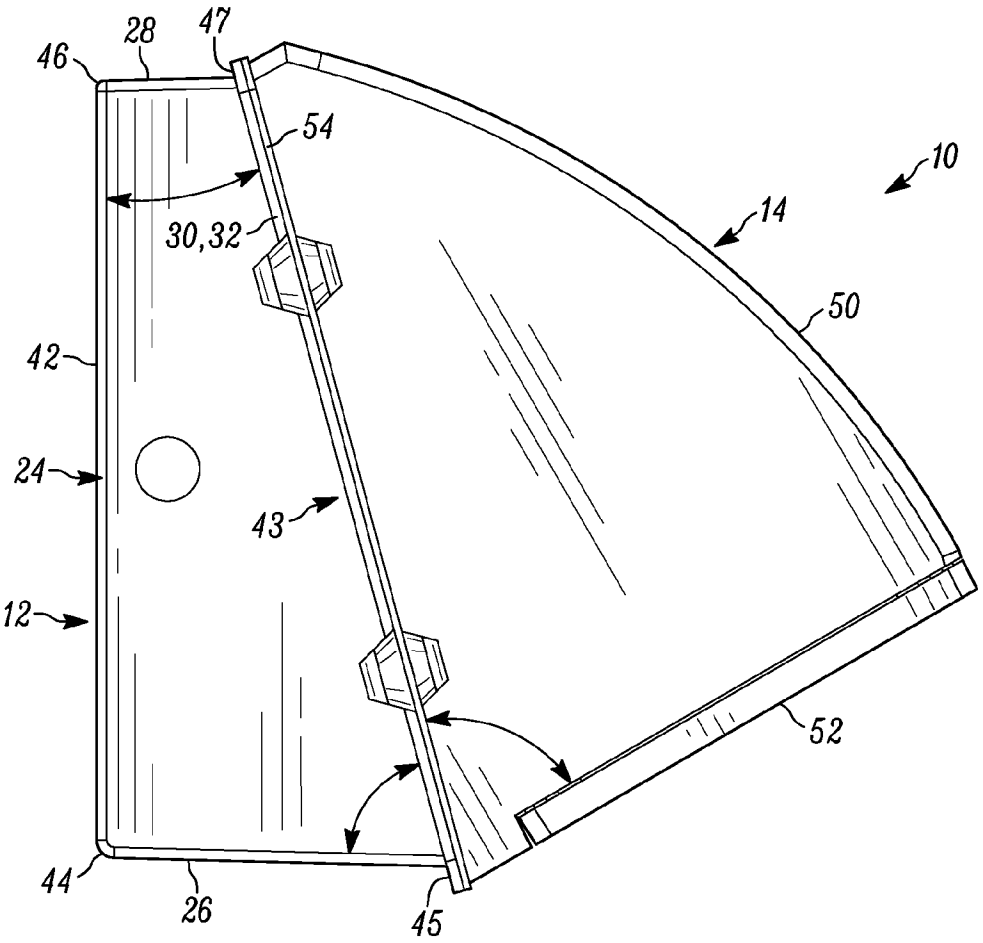
FIG. 4 of the drawings is a side elevational view of the wall mount light assembly of the present disclosure, showing, in particular, the mounting base coupled to the light housing in the second orientation.
Figure 5:
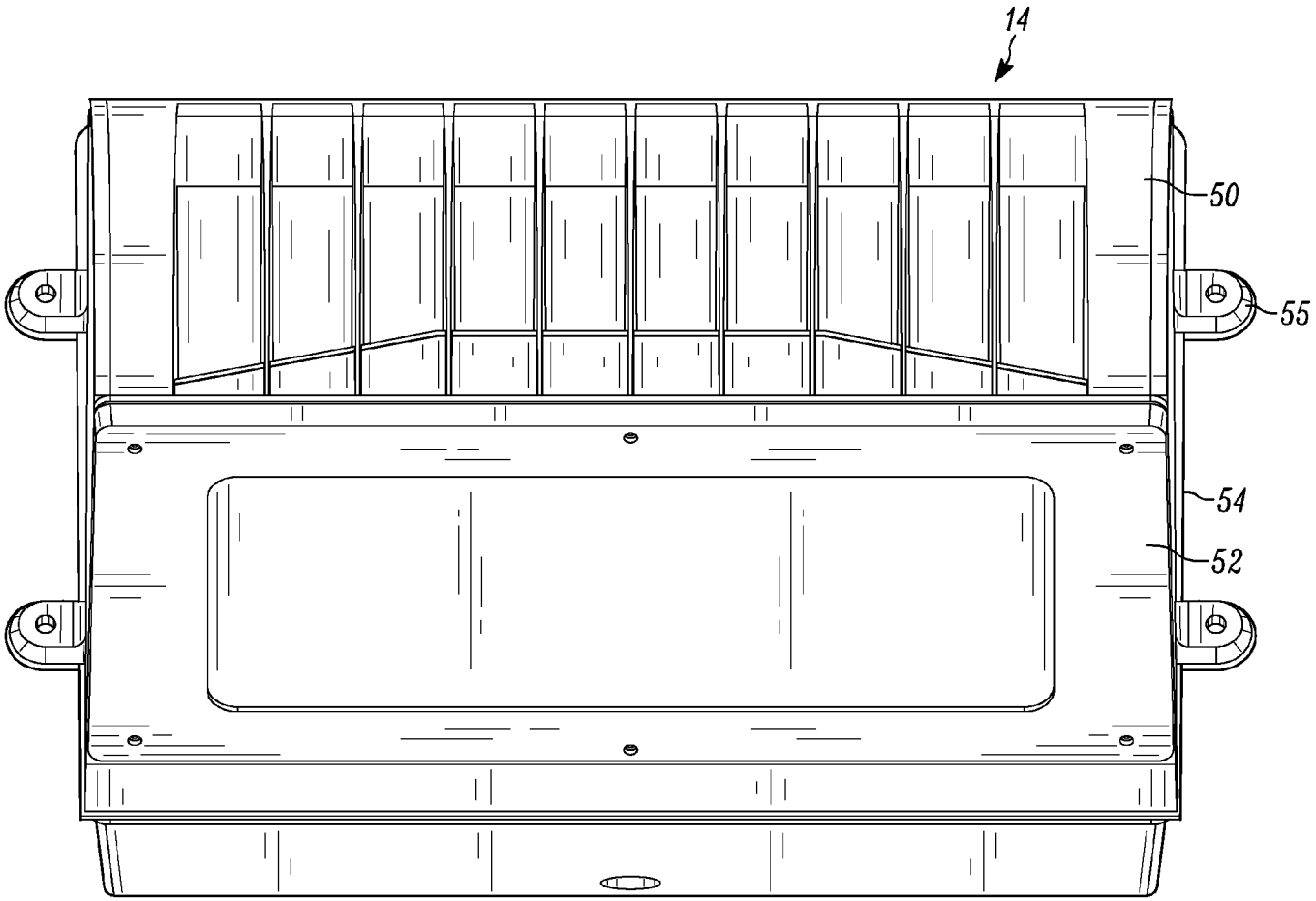
FIG. 5 of the drawings is a front elevational view of the wall mount light assembly of the present disclosure, showing, in particular, the mounting base coupled of the light housing in the second orientation.
Figure 6:
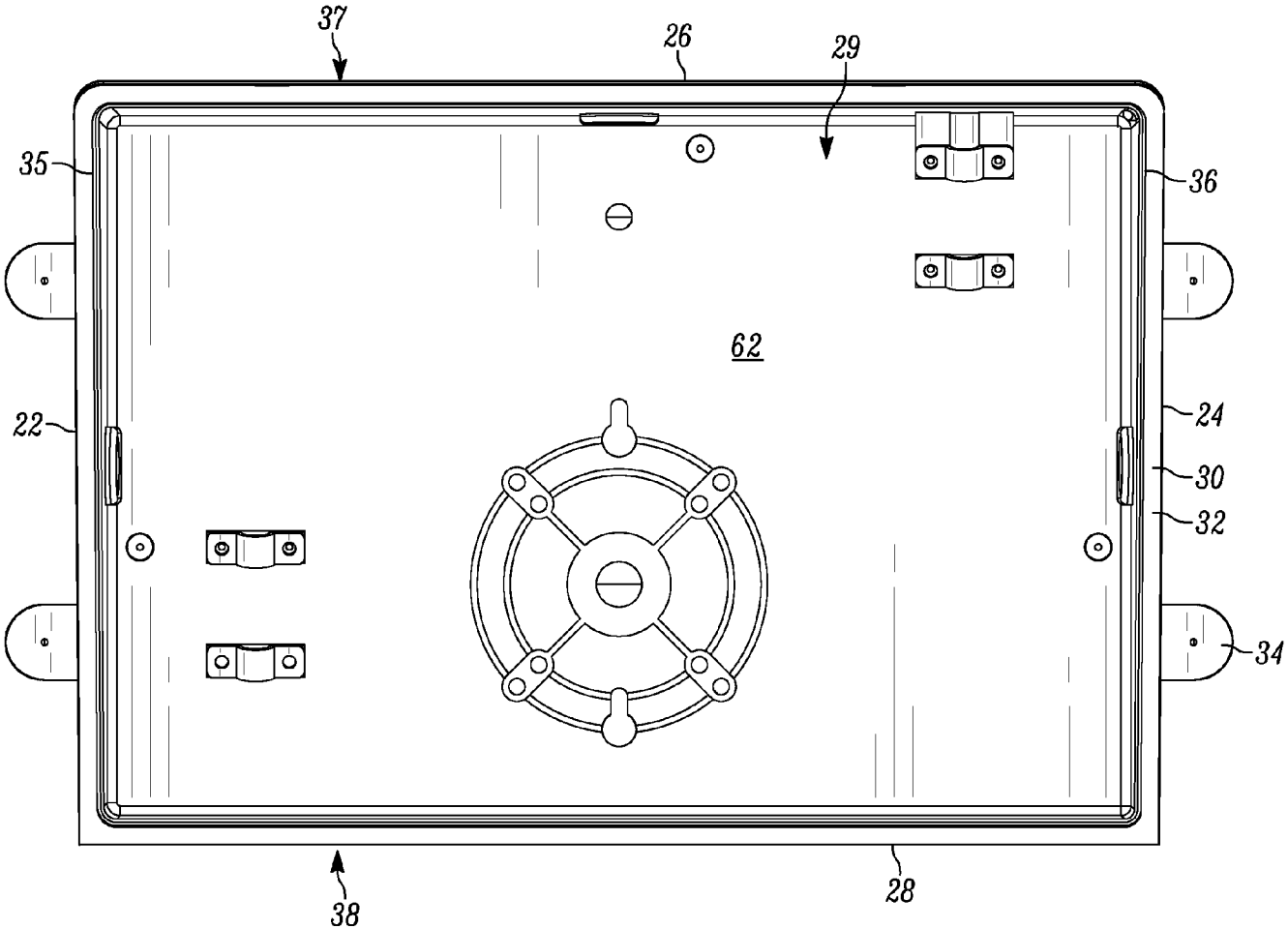
FIG. 6 of the drawings is a front plan view of the mounting base of the present disclosure, showing, in particular, the cavity defined thereby.

If, however, the mounting base is rotated a half turn and mounted what would amount to an upside down orientation relative to the orientation shown in FIG. 1, and the light housing 14 is mounted in the same manner as in FIG. 1, the lens portion will be oblique to the wall to which the wall mount light assembly 10 is mounted (and, in turn, oblique to the base wall 20 of the mounting base 12). Such a configuration is shown in FIGS. 4 and 5. As a result, the light will be directed through the lens portion in a downward and outward configuration.

As a result, the same light can be utilized in two different manners, depending on the manner of mounting. In turn, only a single light assembly is required to wire any number of installations, where the installations require either one of the different configurations.

To install the wall mount light assembly of the present disclosure, the user first selects a wall or building side, or other structure upon which to install the assembly. Once selected, the user attaches the mounting base 12 to the wall in the desired orientation. That is, the user decides if the mounting base is coupled in the manner shown in FIG. 1 or in the manner shown in FIG. 2. Generally, the mounting base is typically coupled to the wall through fasteners which attach directly to the wall, or to an electrical conduit. Once attached, the user may extend conduit into the cavity 29 of the mounting base 12.

Next, the user electrically coupled the light element in the light housing. Once electrically coupled, the user can attach the mating perimeter 54 of the light housing to the flange of the front opening perimeter 30 of the mounting base 12. Once coupled together, a number of different mounting structures may be employed to maintain the mounting base and the light housing in engagement and attachment. For example, screws or the like may be utilized.

At any time, the user may desire to change the orientation of the light from that which is shown in FIGS. 1 through 3 to that which is shown in FIGS. 4 and 5. In such an instance, the user can remove the mounting base 12 from the wall and rotate the mounting base a half turn prior to reattachment.

Advantageously, only a single mounting base and a single light housing needs to be manufactured for assembly into the different configurations. Heretofore, it has been necessary to provide either two different mounting bases or two different light housings, or to have complicated adjustment means therebetween. The disclosure eliminates the need for any of the foregoing. It is contemplated that the front opening perimeter is angled relative to the base wall at an angle of between 10° and 60°. The lens portion and the mating perimeter are angled relative to each other at an angle of between 75° and 85°. Such a configuration allows for the repositioning of the light into at least two orientations that are commonly utilized with a single mounting base and a single light housing. Of course other angles are contemplated.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A wall mount light assembly comprising:

a mounting base having a base wall, and a plurality of walls extending outwardly therefrom, terminating at a distal end, and cooperatively defining a front opening perimeter, with the base wall and the front opening perimeter being oblique to each other; and a light housing comprising a lens portion and a mating perimeter, the lens portion and the mating perimeter being oblique to each other;

wherein the mating perimeter of the light housing and the front opening perimeter configured to matingly engage in at least two different orientations, whereby in each of the orientations, the position of the base wall relative to the lens portion is different, so as to direct a light emanating through the lens portion in a different direction.

2. The wall mount light assembly of claim 1 wherein the at least two different orientations comprise a first orientation and a second orientation, wherein in the second orientation, the mounting base is rotated a half turn relative to the first orientation.

3. The wall mount light assembly of claim 2 wherein in the first orientation, the light emanating through the lens portion is directed in a generally downward direction, with the lens portion substantially perpendicular to the base wall, and in the second orientation, the light emanating through the lens portion is directed in a direction that is outward and downward, with the lens portion being substantially oblique to the base wall.

4. The wall mount light assembly of claim 3 wherein the base wall comprises a substantially rectangular member, and the front opening perimeter comprises a substantially rectangular member.

5. The wall mount light assembly of claim 4 wherein the plurality of walls of the mounting base comprise a pair of ends which are parallel to each other and spaced apart from each other, and a pair of sides that extend between the pair of ends.

6. The wall mount light assembly of claim 5 wherein the plurality of walls define a substantially rectangular member.

7. The wall mount light assembly of claim 6 wherein the pair of sides has a first side that has a first width and the second side has a second width, the first width being larger than the second width.

8. The wall mount light assembly of claim 7 wherein the light emanating from the lens portion comprises one of a discharge, LED and incandescent light.

9. The wall mount assembly of claim 6 wherein the light housing is coupled to the mounting base through at least one removable fastener.

10. The wall mount light assembly of claim 5 wherein the front opening perimeter is angled relative to the base wall at an angle of between 10° and 60°, and wherein the lens portion and the mating perimeter are angled relative to each other at an angle of between 75° and 85°.

11. A method of redirecting a wall mount light assembly comprising the steps of:

providing a mounting base with a base wall and a front opening perimeter spaced apart from the mounting base and oblique thereto, the base wall and front opening perimeter defining a cavity;

providing a light housing including a lens portion and a mating perimeter spaced apart from the lens portion, and disposed obliquely thereto;

positioning the mating perimeter in mating engagement with the front opening perimeter in a first orientation, wherein the lens portion is directed at a first angle relative to the base wall; and repositioning the mating perimeter in mating engagement with the front opening perimeter in a second orientation, wherein the lens portion is directed at a second angle relative to the base wall, wherein the first angle and the second angle are different.

12. The method of claim 11 wherein the step of repositioning further comprises the steps of rotating the light housing relative to the mounting base through a half turn; and positioning the mating perimeter in mating engagement with the front opening perimeter in the second orientation.

13. The method of claim 12 wherein the step of positioning further comprises the step of releasably attaching the light housing to the mounting base through at least one fastener, and the step of repositioning further comprising the step of releasing the light housing from the mounting base.

14. The method of claim 13 wherein the step of repositioning further includes the step of reattaching the light housing to the mounting base in releasable engagement.

* * * * *